US006913001B2

(12) United States Patent
Abdolhosseini et al.

(10) Patent No.: US 6,913,001 B2
(45) Date of Patent: Jul. 5, 2005

(54) HYDROCARBON ADSORBING DEVICE FOR ADSORBING BACKFLOW OF HYDROCARBONS FROM A VEHICLE ENGINE

(75) Inventors: Reza Abdolhosseini, West Bloomfield, MI (US); Gregory Scott Green, Dearborn, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/464,691

(22) Filed: Jun. 18, 2003

(65) Prior Publication Data

US 2004/0255911 A1 Dec. 23, 2004

(51) Int. Cl.[7] ..... F02M 33/02
(52) U.S. Cl. ..... 123/519; 123/518
(58) Field of Search ..... 123/518, 519, 123/520, 521

(56) References Cited

U.S. PATENT DOCUMENTS

| | | | | |
|---|---|---|---|---|
| 4,363,644 A | | 12/1982 | Sato et al. | |
| 5,207,734 A | * | 5/1993 | Day et al. | 60/278 |
| 5,538,697 A | | 7/1996 | Abe et al. | |
| 5,582,003 A | | 12/1996 | Patil et al. | |
| 5,619,853 A | | 4/1997 | Brown | |
| 5,657,626 A | | 8/1997 | Brown et al. | |
| 5,765,369 A | | 6/1998 | Tanaka et al. | |
| 5,771,684 A | | 6/1998 | Hertl et al. | |
| 5,787,707 A | | 8/1998 | Hertl et al. | |
| 5,850,734 A | | 12/1998 | Ketcham | |
| 5,934,069 A | | 8/1999 | Hertl et al. | |
| 5,941,068 A | | 8/1999 | Brown et al. | |
| 6,220,022 B1 | | 4/2001 | Muller et al. | |
| 6,230,693 B1 | * | 5/2001 | Meiller et al. | 123/519 |
| 6,422,006 B2 | | 7/2002 | Ohmori et al. | |
| 6,692,551 B2 | * | 2/2004 | Wernholm et al. | 95/146 |

* cited by examiner

*Primary Examiner*—Bibhu Mohanty
(74) *Attorney, Agent, or Firm*—Brinks Hofer Gilson & Lione

(57) ABSTRACT

The present invention involves an air induction system having a hydrocarbon adsorbing feature for adsorbing backflow of hydrocarbons from a vehicle engine. The air induction system includes an air filter for filtering ambient air, a clean air duct in fluid communication with the air filter, sensor mounted adjacent the clean air duct, and a hydrocarbon adsorber mounted to the clean air duct for adsorbing backflow of hydrocarbons from the engine. The hydrocarbon adsorber includes an outer body having an air inlet end and an air outlet end. The body is comprised of hydrocarbon adsorbing material and has a configuration of connected inner walls disposed therein and spaced apart from each other.

17 Claims, 4 Drawing Sheets

HYDROCARBON ADSORBING DEVICE FOR ADSORBING BACKFLOW OF HYDROCARBONS FROM A VEHICLE ENGINE

TECHNICAL FIELD

This invention generally relates to an air induction system having a hydrocarbon adsorbing device for adsorbing backflow of hydrocarbons from a vehicle engine.

BACKGROUND

Internal combustion engines today include electronic controls to provide optimal engine operation. One important sensor for achieving optimal engine control is a mass air flow sensor (MAFS) for measuring air intake into an internal combustion engine.

It is important that the mass air flow measurement is accurate to provide optimal engine operation. One significant problem affecting the mass air flow measurement is the turbulence in the air flow that could result in high noise-to-signal output. Prior art hydrocarbon adsorbers have attempted to address this problem by providing devices that reduce the turbulence of the entire flow field. Typically, the prior art devices use either a grid or a screen. While prior art devices reduce the turbulence of the entire flow field, they are susceptible to freezing and therefore cutting off air flow to the engine. Additionally, these devices are costly to manufacture.

Moreover, it is also important to that hydrocarbons, such as fuel, are restricted or prevented from dissipating from the engine into the atmosphere after engine shutoff. Without restrictions, after engine shutdown, gaseous unburnt fuel located upstream of the engine would typically dissipate upstream the intake manifold and through the throttle body of the vehicle. The fuel then travels through the engine's clean air duct, across the air filter and is emitted into the atmosphere. This is undesirable. Manufacturers have been challenged to provide an integral system which reduces turbulence of the entire flow field and restricts unburnt fuel at the engine from dissipating to the atmosphere.

Therefore, there is a need in the automotive industry to improve the design of devices that deliver low turbulent flow field to the mass air flow sensor without affecting significant pressure drop and restrict unburnt fuel at the engine from dissipating to the atmosphere.

SUMMARY

The present invention provides an air induction system having a hydrocarbon adsorption feature for adsorbing backflow of hydrocarbons from a vehicle engine. The air induction system comprises an air filter for filtering ambient air, a clean air duct, a sensor, and a hydrocarbon adsorber. The clean air duct is in fluid communication with the air filter and has first and second ends. The first end is connected to the air filter. The sensor is mounted adjacent the second end of the clean air duct and is configured to receive the air from the air filter. The hydrocarbon adsorber is mounted to the clean air duct for adsorbing backflow of hydrocarbons from the engine. The hydrocarbon adsorber includes an outer body having an air inlet end and an air outlet end. The body is comprised of hydrocarbon adsorbent material and has a configuration of connected inner walls disposed therein and spaced apart from each other by radially increasing intervals from the center of the configuration.

In another embodiment, the present invention provides a hydrocarbon adsorber of an air induction system for adsorbing backflow of hydrocarbons from a vehicle engine. The hydrocarbon adsorber comprises an outer body having an air inlet end and an air outlet end. The body is comprised of hydrocarbon adsorbent material. The hydrocarbon adsorber further comprises a configuration of connected inner walls disposed therein and spaced apart from each other by radially increasing intervals from the center of the configuration.

Further features and advantages of the invention will become apparent from the following discussion and the accompanying drawings in which:

DETAILED DESCRIPTION

The following description of the preferred embodiment is merely exemplary in nature and is in no way intended to limit the invention or its application or uses.

Figure 1:
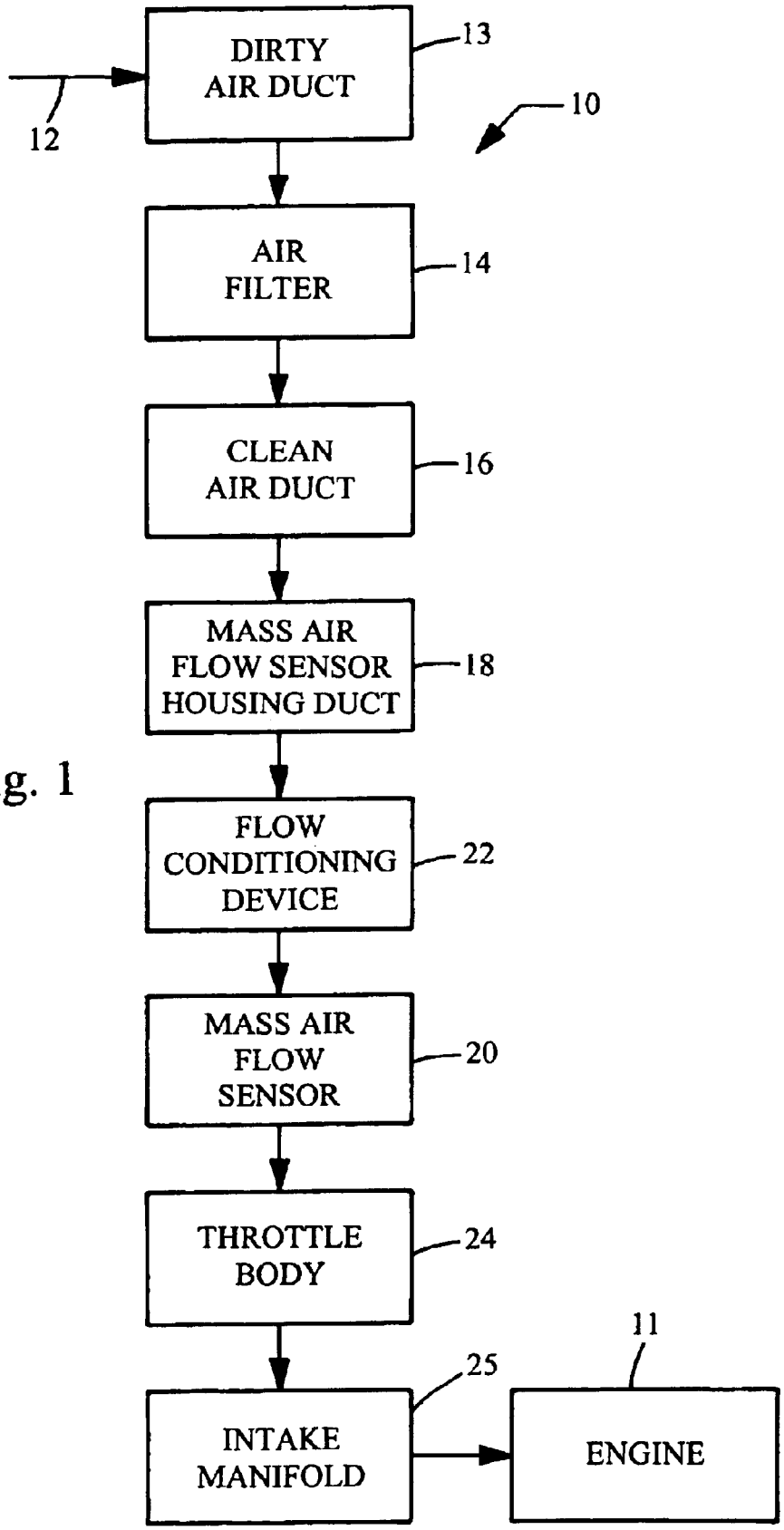
FIG. 1 is a block diagram of an air induction system in accordance with one embodiment of the present invention.

Referring in particular to FIG. 1, an air induction system installed in the vicinity of an engine 11 in an automobile is generally shown and represented by reference numeral 10. The air induction system 10, functions to filter and meter the air intake flow from the outside into the engine 11. The direction of the air flow from the outside to the engine is shown by reference numeral 12.

The air induction system 10 comprises a dirty air duct 13, an air filter 14, a clean air duct 16, a mass air flow sensor (MAFS) housing duct 18, a mass air flow sensor (MAFS) 20 and hydrocarbon adsorber 22 which is a flow conditioning device. The air induction system 10 also comprises a throttle body 24 connected to the MAFS housing 18. The drawings the throttle body 24 is typically connected to an intake manifold 25. The intake manifold 25 is connected to the engine 11. The throttle body 24 used in the present invention is well known in the art and therefore is not explained in detail.

The air filter 14 functions to filter the air drawn or inducted from the outside before it is delivered to the engine 11. The air filter 14 used in the present invention is well known in the art and therefore not explained in detail. The air filter 14 is connected to the clean air duct 16 such that the air after being filtered by the air filter 14 flows to the clean air duct 16.

Figure 2:
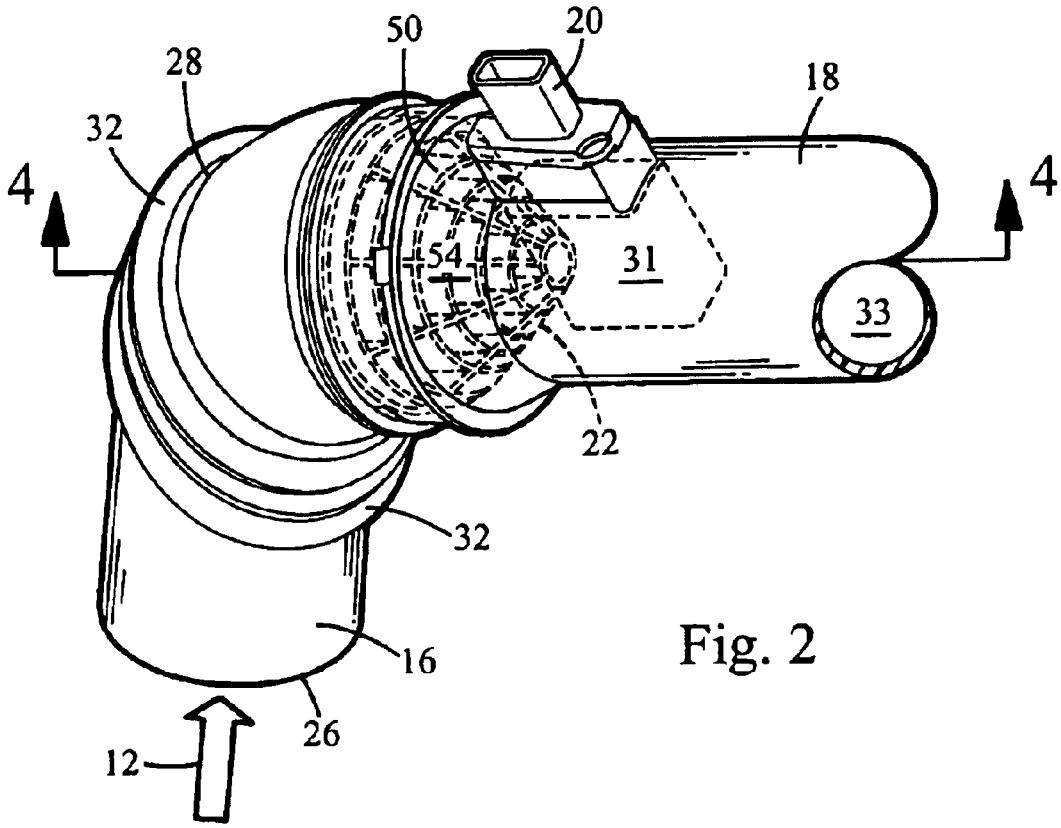
FIG. 2 is a perspective view of the air induction system in accordance with one embodiment of the present invention.
Figure 3:
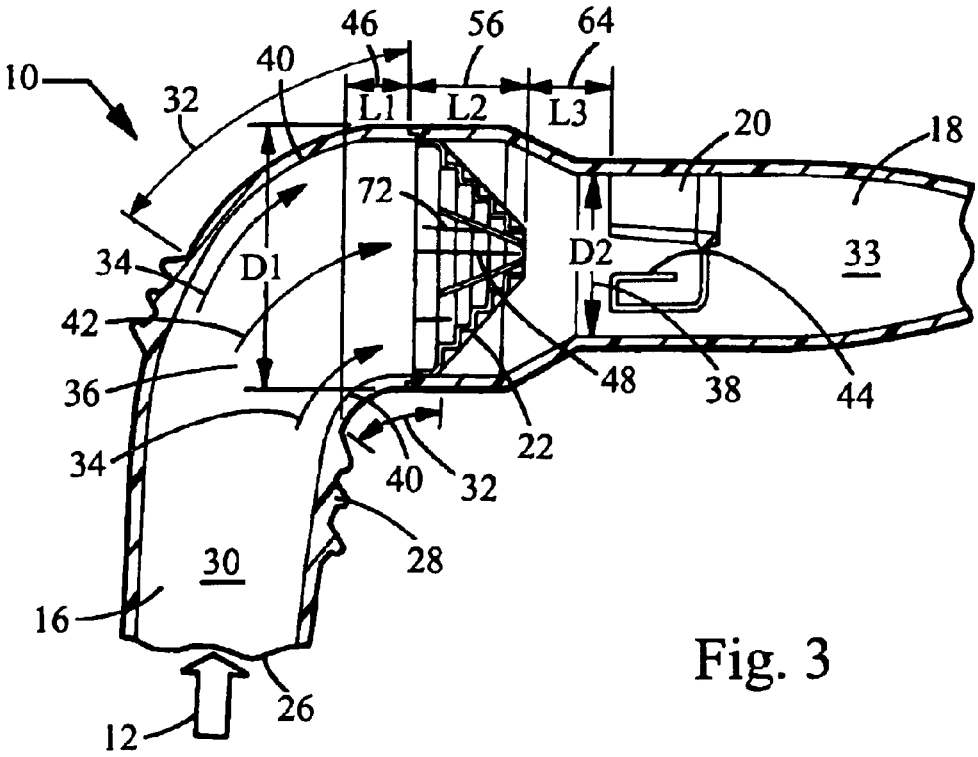
FIG. 3 is a perspective side view the air induction system of FIG. 2.

Referring in particular to FIGS. 2 and 3 the clean air duct 16 at one end 26 is connected to the air filter 14 (not shown in FIG. 1) and the second end 28 is connected to the MAFS housing duct 18. The clean air duct 16 has a hollow interior passage 30 that facilitates the flow of the air from the air filter 14 to the MAFS housing duct 18. In order to accommodate the limited space available in the motor vehicle, the clean air duct 16 defines an air tight bend 32. The air flowing through the bend 32 in the MAFS housing duct 18, defines a curved air flow path such that the air is expanded in the area of the bend 32. Referring in particular to FIG. 3, the diameter of the MAFS housing duct 18 in the area of the bend 32 is $D_1$ and is shown by reference numeral 36. The clean air duct 10 may be formed of any material such as plastic, metal, or composites and by any process known for manufacturing duct from such materials.

With continued reference to FIGS. 2 and 3, the MAFS housing duct 18, attached to the second end 28 of the clean air duct 16, functions to house the mass air flow sensor (MAFS) 20. The MAFS housing duct 18 defines an exterior surface 31 and an interior hollow passage 33 to allow air to flow through it. The MAFS housing duct 18 preferably has a reducing cross-section downstream from the bend 32 such that the diameter is $D_2$ represented by reference numeral 38. Since the cross section of MAFS housing duct 18 reduces in the direction of the air flow 12, the air accelerates as it passes through the MAFS housing duct 18.

The air flowing through the bend 32 may result in adverse pressure gradient due to the air encountering the interior wall 40 of the passage 30 in the clean air duct 16. Due to the air encountering the interior wall 40, the air shown by arrows 34 near the walls 40 of the clean air duct 16 is more turbulent than the air shown by arrow 42 around the center of the clean air duct 16. Turbulence is also caused due to inconsistent air flow 12 due to surface imperfections in the clean air duct 16 or the MAFS housing duct 18.

With continued reference to FIGS. 2 and 3, in order to measure the amount of air inducted into the engine, the air inductions system 10 includes a Mass Air Flow Sensor (MAFS) 20. The MAFS 20 is located downstream from the clean air duct 16 and upstream from the throttle body 24 directly in the path of the air flow 12. As mentioned above the MAFS 20 is housed inside the MAFS housing duct 18. Air enters MAFS 20 through a MAFS entrance 44 provided in MAFS 20. In order to convert the amount of air drawn into the engine 11 into a voltage signal, MAFS 20 is also provided with a sensor (not shown). The air passes from the MAFS entrance 44 to the sensor, where the exact amount of air is measured by the sensor. The MAFS entrance 44 is located downstream in the direction of air flow path 12 and is positioned directly behind the hydrocarbon adsorber 22. Therefore, the air exiting the hydrocarbon adsorber 22 directly enters the MAFS entrance 44 and is measured by the sensor provided in the MAFS 20.

Referring in particular to FIGS. 2–4*c*, in order to regulate the flow of the air before the air enters the MAFS opening 44, the air induction system 10 is provided with a means for conditioning the flow such as the hydrocarbon adsorber 22 which is a flow conditioning device. As shown in the figures, the hydrocarbon adsorber 22 is preferably inserted inside the MAFS housing duct 18 and is disposed in the center of MAFS housing duct 18. Alternatively, it may be positioned between the clean air duct 16 and the MAFS housing duct 18. The hydrocarbon adsorber 22 is located in the air flow path 12 upstream from the MAFS entrance 44 but downstream from the bend 32 in the MAFS housing duct 18. Preferably, the hydrocarbon adsorber 22 is located at a distance $L_1$ (represented by reference numeral 46) from the bend 32. This distance $L_1$ can vary depending on the packaging of air induction system 10 inside the motor vehicle.

The hydrocarbon adsorber 22 is preferably mounted to or adjacent the second end of the clean air duct upstream of the sensor. The hydrocarbon adsorber extends toward the MAFS opening 40. As shown, the hydrocarbon adsorber 22 includes an outer body 41 having an air inlet end 60 and an air outlet end 62 through which clean ambient air passes from the air filter. In this embodiment, the air enters the hydrocarbon adsorber 22 from the MAFS housing duct 18 through the inlet end 60 and exits the hydrocarbon adsorber 22 through the outlet end 62 to the MAFS opening 40. The outlet end 62 of the hydrocarbon adsorber 22 is positioned at distance $L_3$ (as shown by reference number 64) from the MAFS entrance 44.

Figure 4A:
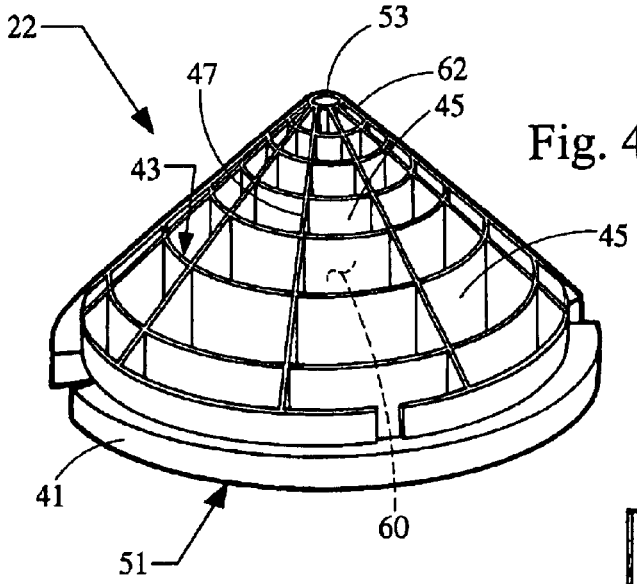
FIG. 4*a* is a perspective view of a hydrocarbon adsorber of the air induction system in accordance with one embodiment of the present invention.
Figure 4B:
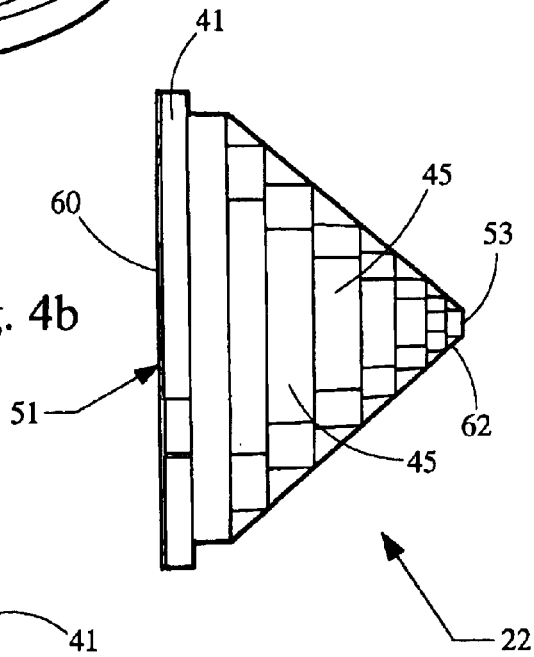
FIG. 4*b* is a side view of the hydrocarbon adsorber of FIG. 4*a;*
Figure 4C:
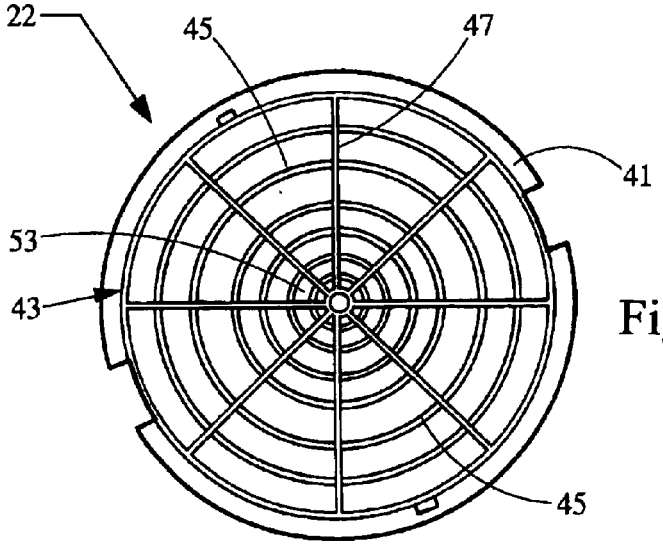
FIG. 4*c* is a cross-sectional view of the hydrocarbon adsorber taken along lines c—c in FIG. 4*a;*

As shown in FIGS. 4*a*–4*c*, the hydrocarbon adsorber 22 has a configuration 43 of connected inner walls 45 disposed within the outer body. In this embodiment, the connected inner walls are arcuate and are coaxial with each other. The inner walls are spaced apart from each other by radially increasing intervals from the center of the configuration. In this embodiment, the configuration of inner walls further includes a plurality of ribs 47 attached to the outer body and radially extending inward to connect with a plurality of inner walls, thereby providing support to the device. The hydrocarbon adsorber may be made of hydrocarbon adsorbing material including activated carbon and zeolites.

In FIGS. 3–4*c*, the air outlet end includes a face 51 through which clean air passes. As shown, the face has a center portion 53 and an outer portion 55 located about the center portion 53. The hydrocarbon adsorber is configured such that relatively low turbulent clean ambient air exits the center portions at the air outlet end 62. This is accomplished by radially outwardly spacing the inner walls in increasing intervals. It has been found that less intervals or space between the inner walls lowers the turbulence in the air flow. It has also been found that radially increasing the space between the inner walls 45 from the center of the face 51 allows sufficient clean air flow to the throttle body for air supply to the engine, thereby preventing undesirable pressure drop across the hydrocarbon adsorber.

It also has been found that there is a direct correlation between the length of the inner walls of the hydrocarbon adsorber and the reduction of turbulence in the air flow therethrough. Thus, in one embodiment, the inner walls of the hydrocarbon adsorber may have axial lengths which increase radially toward the center portion and decrease radially away from the center portion of the face of the outlet end. Of course, the lengths may be the same or vary based on vehicle restrictions.

Thus, in this embodiment, the center portion of the face includes relatively fine spaced inner walls in increasing space or intervals therein and the outer portion includes relatively course spaced inner walls in increasing space therein. As shown, the center portion of the face is in alignment with the MAFS 20 for allowing only low turbulent clean air to be received by the MAFS 20 and the outer portion of the face allows turbulent clean air flow towards the throttle body for air supply to the engine.

It is to be noted that the number of inner walls, the spacing between the inner walls, and the lengths of the inner walls may vary based on pressure gradient, air flow, and other variable restrictions as they may vary between vehicle engines.

The hydrocarbon adsorber 22 defines a longitudinal axis 48 that is parallel to the air flow 12. The length of the hydrocarbon adsorber $L_2$ is represented by reference numeral 56. Preferably the $L_2$ of the hydrocarbon adsorber 22 is such that the air passing through the hydrocarbon adsorber 22 is streamlined before the air enters the MAFS entrance 44. The hydrocarbon adsorber 22 may be made by any suitable means such as die molding or injection molding.

Figure 5:
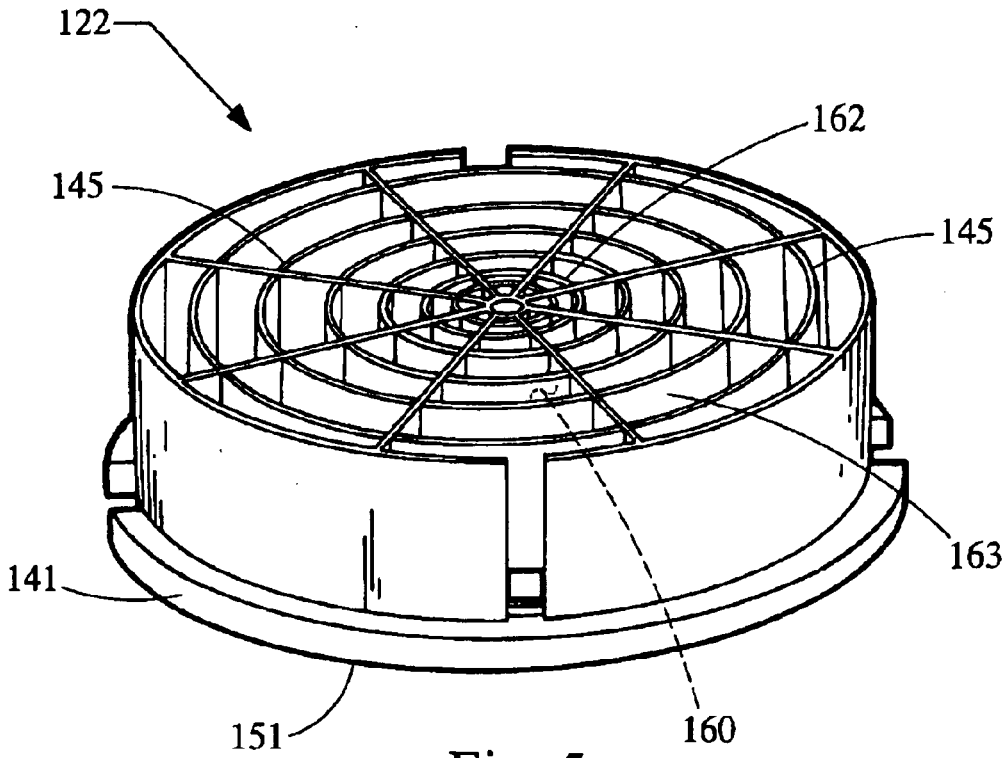
FIG. 5 is a perspective view of a hydrocarbon adsorber of the air induction system in accordance with another embodiment of the present invention.

Referring to FIG. 5, an alternate embodiment of the hydrocarbon adsorber is shown and is indicated by reference numeral 122. In this embodiment, the hydrocarbon adsorber 122 includes similar components as a hydrocarbon adsorber 22, such as a body 141, an air inlet end 160, an air outlet end 162, and a face 151. The hydrocarbon adsorber 122 further includes a configuration of inner walls having an arcuate structure 163 as in hydrocarbon adsorber 22. However, as shown, the lengths of the connected inner walls 145 are equal to each other. As in the embodiment mentioned above, the inner walls are also spaced apart in radially increasing increments from the center of the face.

Figure 6:
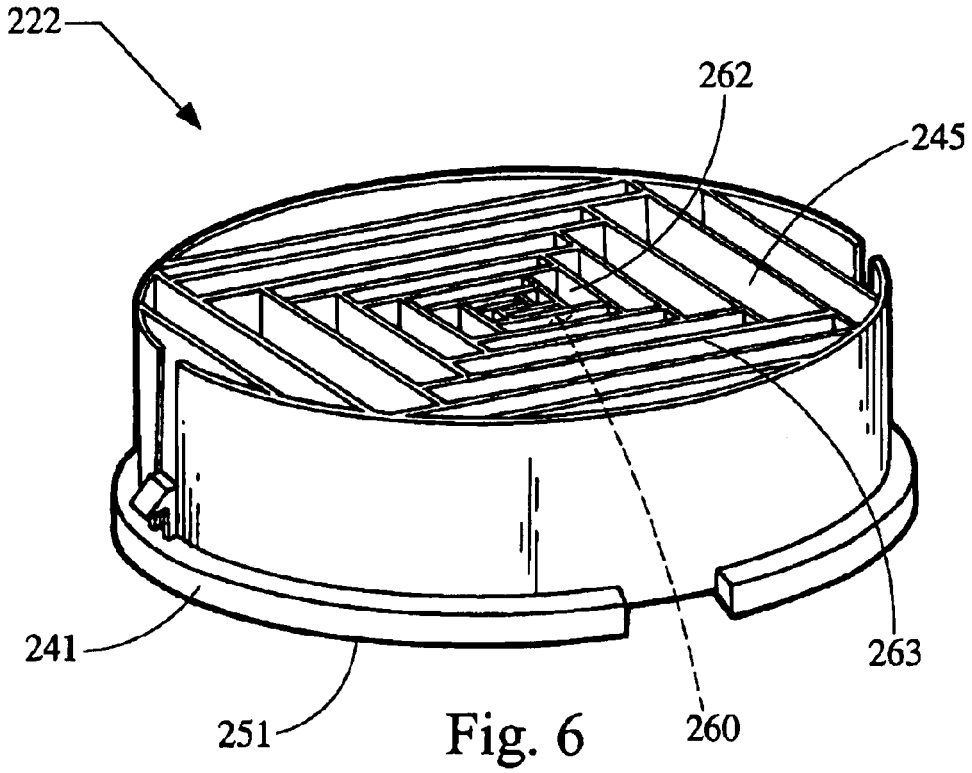
FIG. 6 is a perspective view of a hydrocarbon adsorber of the air induction system in accordance with yet another embodiment of the present invention.

Referring in particular to FIG. 6, another alternate embodiment of the hydrocarbon adsorber is shown and is indicated by reference numeral 222. In this embodiment, the hydrocarbon adsorber 222 includes similar components as the hydrocarbon adsorber 22, such as a body 241, an air inlet end 260, an air outlet end 262, and a face 251. However, hydrocarbon adsorber 222 includes a configuration of inner walls having a planar structure 263. As in the embodiment mentioned above, the inner walls also are space apart in radially increasing increments from the center of the face.

In order to mount the hydrocarbon adsorber 22 to the MAFS housing duct 18, the external surface 50 of the hydrocarbon adsorber 22 is provided with a fastening mechanism. As shown, the inlet end 60 of the hydrocarbon adsorber 22 preferably has an outwardly extending rim 74 that fits around the MAFS housing duct 18. Preferably, the rim 74 is provided with a plurality of locking devices 76 such that the hydrocarbon adsorber 22 can be securely locked to the MAFS housing duct 18.

Referring in particular to FIGS. 2–4*c*, the flow of air through various components in the air induction system is shown in detail. As shown, the air flow from the air filter 14 to the clean air duct 16 is generally shown by reference numeral 12. As explained above, as air passes through the bend 32 in clean air duct 16, the air may become turbulent near the walls 40 of the passage 30. As described above, the turbulent air near the walls 40 of the clean air duct 16 is represented by reference numeral 34. The less turbulent air around the center of clean air duct 16 is represented by reference numeral 42. As explained above, the hydrocarbon adsorber 22 is oriented around the center of MAFS housing duct 18. Therefore, only the air 42 around the center of clean air duct 18 enters through the inlet 60 of the hydrocarbon adsorber 22. Since the MAFS entrance 44 is aligned with the outlet 62 of the hydrocarbon adsorber 22, only the air exiting the center of the outlet 62 shown by reference numeral 84 enters the MAFS entrance 44. The turbulent air 34 passes through the outside surface 50 of the center portion, thereby bypassing the MAFS entrance 44. Since the hydrocarbon adsorber 22 reduces the turbulence of the air flow 34 when entering the MAFS entrance 44, there is substantial improvement in the noise to signal output measured by MAFS 20.

As shown, since the hydrocarbon adsorber 22 can be manufactured separate from the other components in air induction system 10, it allows flexibility in the positioning and the dimensions in manufacturing of the hydrocarbon adsorber 22. For example, depending on the packaging of the air induction system 10, the distance $L_1$ can be either increased or decreased. Additionally, the length and the distance from MAFS 20 can be also changed.

As any person skilled in the art will recognize from the previous description and from the figures and claims, modifications and changes can be made to the preferred embodiment of the invention without departing from the scope of the invention as defined in the following claims.

What is claimed is:

1. A hydrocarbon adsorber of an air induction system for adsorbing backflow of hydrocarbons from a vehicle engine, the hydrocarbon adsorber comprising:

an outer body having an air inlet end and an air outlet end, the body being comprised of hydrocarbon adsorbing material; and a configuration of connected inner walls disposed therein and spaced apart from each other, the inner walls having an axial length decreasing radially from the center.

2. The hydrocarbon adsorber of claim 1 wherein the hydrocarbon adsorbing material includes activated carbon and zeolite.

3. The hydrocarbon adsorber of claim 1 wherein the connected inner walls are coaxial with each other.

4. The hydrocarbon absorber of claim 1 wherein the hydrocarbon adsorber further includes at least one rib attached to the outer body and extending to at least one of the inner walls.

5. The hydrocarbon adsorber of claim 3 wherein the inner walls have substantially equal axial lengths.

6. The hydrocarbon adsorber of claim 1 wherein the air outlet end includes a face through which clean air passes, the face having a center portion through which low turbulent air passes and an outer portion being about the center portion and through which high turbulent air passes.

7. A hydrocarbon adsorber of an air induction system for adsorbing backflow of hydrocarbons from a vehicle engine, the hydrocarbon adsorber comprising:

an outer body having an air inlet end and an air outlet end, the body being comprised of hydrocarbon adsorbing material; and a configuration of connected inner walls disposed therein and spaced apart from each other, the configuration of connected inner walls being spaced apart from each other by radially increasing intervals from the center of the configuration.

8. An air induction system having a hydrocarbon adsorption feature for adsorbing backflow of hydrocarbons from a vehicle engine, the system comprising:

an air filter for filtering ambient air;

a clean air duct in fluid communication with the air filter, the clean air duct having first and second ends, the first end being connected to the air filter;

a sensor mounted adjacent the second end of the clean air duct, the sensor being configured to receive the air from the air filter; and a hydrocarbon adsorber mounted to the clean air duct for adsorbing backflow of hydrocarbons from the engine, the hydrocarbon adsorber including an outer body having an air inlet end and an air outlet end, the body being comprised of hydrocarbon adsorbing material and having a configuration of connected inner walls disposed therein, the configuration of connected inner walls being spaced apart from each other by radially increasing intervals from the center of the configuration.

9. The system of claim 8 wherein the hydrocarbon adsorber is mounted to the second end of the clean air duct.

10. The system of claim 8 wherein the hydrocarbon adsorbing material includes activated carbon and zeolite.

11. The system of claim 8 wherein the connected inner walls are coaxial with each other.

12. The system of claim 11 wherein the inner walls have an axial length decreasing radially from the center.

13. The system of claim 8 wherein the hydrocarbon adsorber further includes at least one rib attached to the outer body and extending to at least one of the inner walls.

14. The system of claim 11 wherein the inner walls have substantially equal axial lengths.

15. The system of claim 8 wherein the air outlet end includes a face through which clean air passes, the face having a center portion through which low turbulent air passes and an outer portion being about the center portion and through which high turbulent air passes.

16. The system of claim 15 wherein the sensor is located downstream of the hydrocarbon adsorber and aligned with the center portion of the face of the air outlet end.

17. The system of claim 8 wherein the is duct further comprises a clean air portion and a sensor housing portion, the sensor being disposed in the sensor housing portion.

* * * * *